United States Patent [19]

Finsterwalder

[11] 3,988,995

[45] Nov. 2, 1976

[54] CONTAINER FOR LIQUEFIED GAS

[76] Inventor: Ulrich Finsterwalder, Pagodenburgstrasse 8 (BRD), 8000 Munich, Germany

[22] Filed: May 12, 1975

[21] Appl. No.: 576,470

[30] Foreign Application Priority Data

May 14, 1974 Germany ..... 2423381
Aug. 20, 1974 Germany ..... 2439763
Nov. 13, 1974 Germany ..... 2453692

[52] U.S. Cl. ..... 114/74 A; 220/916
[51] Int. Cl.[2] ..... B63B 25/12
[58] Field of Search ..... 114/74 R, 74 A; 220/9 R, 9 A, 9 LG, 9 F; 62/240

[56] References Cited

UNITED STATES PATENTS

| | | | |
|---|---|---|---|
| 3,026,577 | 3/1962 | Dosker | 114/74 A |
| 3,337,079 | 8/1967 | Clarke et al. | 114/74 A |
| 3,457,890 | 7/1969 | Rivas et al. | 114/74 A |
| 3,547,301 | 12/1970 | Ffooks | 114/74 A |
| 3,814,275 | 6/1974 | Lemons | 220/9 LG |

*Primary Examiner*—Trygve M. Blix
*Assistant Examiner*—Jesus D. Sotelo
*Attorney, Agent, or Firm*—Toren, McGeady and Stanger

[57] ABSTRACT

A container for liquefied gas in which a vapor-tight sealing layer is placed on the inside of an outer layer of reinforced concrete. On the inside of the vapor-tight sealing layer, a heat insulating layer is deposited consisting of closed-cell synthetic resin foam.

12 Claims, 9 Drawing Figures

CONTAINER FOR LIQUEFIED GAS

BACKGROUND OF THE INVENTION

The invention relates to a container for liquefied gas.

It is known for containers for liquefied gas, such as Liquefied Natural Gas (LNG), which is stored and transported at a temperature of −162° C, to be made of a material which is ductile at cryogenic temperatures, e.g. nickel steel or aluminum, and for a heat insulating layer to be provided on the outside thereof. In the case of land tanks it is also necessary for safety reasons to provide an external self-supporting protecting container of reinforced or prestressed concrete. In the case of floating containers a special floating body, for example a ship's hull made of steel, is necessary. Between the container and the floating body there must be provided a second barrier, for example a layer of plywood. This layer has the purpose of preventing the cold liquid from coming into direct contact with the floating body in the event of a leak in the container, which would lead to immediate embrittlement of the material to the point of fracture, since for reasons of cost the floating body cannot also be made of a material which is ductile at cryogenic temperatures.

It is also known for a container for liquified gas to be made self-supporting of steel or aluminum which is ductile at cryogenic temperatures with an internal heat insulating layer. For safety, the same measures are necessary here for land tanks and floating tanks as in the case of containers with external heat insulation.

Finally, there are also known containers or reinforced concrete with an internal, non-load-bearing sealing layer of steel or aluminum which is ductile at cryogenic temperatures and with an external heat insulating layer. In this design, both the concrete container and the sealing layer necessary to ensure fluid-tightness become cold. For protection of the external heat insulating layer there is necessary a second external container in the case of land tanks or a separate hull in the case of ships.

SUMMARY OF THE INVENTION

The object of the invention is to avoid disadvantages of the known liquid gas containers and to devise an economical and technically improved solution.

The invention lies in that the load-bearing container structure consists of reinforced or prestressed concrete with a reinforcement of steel which is ductile at cryogenic temperatures, and that on the inside of the container walls there is provided a vapor-tight sealing layer and on the latter a heat insulating layer applied in layers and consisting of closed-cell synthetic-resin foam, for example polyurethane foam.

In the case of land tanks, the advantage of this design may be seen in that the construction of the load-bearing container of cold-resisting concrete with a sealing layer applied to the inside thereof is simpler and less costly than a construction of which is ductile at cryogenic temperatures.

Reinforced concrete or prestressed concrete with a reinforcement of steel which is ductile at cryogenic temperatures is particularly well suited to a container of this type on account of its cold-strength. Since in use it will be at normal temperatures and only becomes cold in the case of a serious accident, the second barrier which would otherwise be necessary for safety reasons can be omitted. For the same reason, a vapor seal spread on with a tool, e.g. one consisting of epoxy resin, is sufficient. The per se known spraying-on of the polyurethane foam in layers and without joints constitutes an advantageous preliminary for the absorption of the tensional stresses arising in the insulation as a result of contact with the liquefied gas, particularly at the edges of the container which are to be rounded. This design is of particular advantage in the case of a floating container, because the load-bearing container structure can serve at the same time as the tank and as the hull of the ship.

The vapor-tight sealing layer plays a dual role in accordance with the invention. Firstly, it prevents the passage of moisture from the warm outside of the cold inside of the container. In this way, moisture is prevented from penetrating into the heat insulating layer and rendering this ineffective by the formation of ice. Secondly, it also prevents the liquefied gas, which is at the boiling point, from escaping from the container. It enables a gas pressure to build up in the heat insulating layer, which maintains the equilibrium of the liquefied gas. This dual role is not the case with known non-load-bearing sealing layers.

The heat insulating layer is advantageously provided, looking from the inside of the container, with holes lying at right angles to the surface and extending only over a part of the thickness of the layer, these being provided at least at those points where the penetration of liquid is a possibility. The diameter of these holes is small, e.g. in the order of 1 mm. The number of holes and the distance between them will depend on the properties of the material used with regard to resistance and tightness against the diffusion of vapor. There would advantageously be one hole per 100 to 5000 $mm^2$ of layer surface.

The drainage of the wet part of the heat insulating layer by means of fine holes arranged at right angles to the surface is a measure which is possible in view of the particular purpose of the insulation. While in the case of normal insulation the penetration of moisture and the consequent reduction in the insulation effect is a great danger, this need not be feared in the case of a cold liquid. This gasifies, and it penetrates and is thereby heated. However, there is necessary in this case a vapor sealing layer which on the one hand prevents the passage of water vapor by diffusion from outside to inside and on the other hand makes possible the build-up of a gas pressure in the insulation which counteracts the pressure of the liquid and maintains it in equilibrium. There is also necessary an insulating material which, like closed-cell polyurethane foam, is tight against the permeation of liquid but is permeable to the diffusion of gas.

The provision of holes in the areas of the heat insulating layer which can become wet, facilitates the build-up of a gas pressure, which in turn prevents the penetration of the liquid. In the holes extending over the wetted area, the liquid which has penetrated gasifies, is forced through the structure of the synthetic resin foam and condenses at the boundary layer at which the temperature is the boiling point, giving rise to a stable state of affairs.

Upon emptying of the tank and subsequent heating of the wet heat insulating layer there occurs a rapid gasification of the moisture in the layer, the gas formed escaping through the holes without causing damage.

Concrete when used as the material for the container has the property when it comes into contact with water or water vapor that it is only apparently water-tight. Normally, of course, the passage of moisture is not noticed, because it is very slight and the moisture immediately evaporates again on the inside of the concrete wall in question. However, if a water-tight vapor sealing layer is arranged on the inside, it is often observed that water formed by condensation of the vapor which has passed through the concrete collects in cavities in the concrete. If, therefore, at individual points the vapor sealing layer does not adhere correctly and firmly to the concrete, which cannot always be avoided even when it is applied with the utmost care, then there can build up a pressure acting directly on the vapor sealing layer, which can give rise to localized detachment of the layer and to the formation of blisters. This phenomenon jeopardizes the vapor sealing layer applied to the inside of a concrete container wall.

If in accordance with a further proposal of the invention there is provided in the container wall a system of interconnecting cavities in which a natural or artificial draught is present, in which case the cavities may be formed by concreted-in tubes of a material which corresponds to concrete as regards its permeability to moisture, preferably of asbestos cement, then it is achieved that the water vapour diffusing through the concrete layer and also capable of passing through the walls of the tubular ducts condenses on the inside walls of these tubes, whence it can run away or be drawn off, if a natural ventilation of the tubes cannot be effected. For artificial ventilation, a circulation of air can be maintained in the tubes by forcing air in.

The tubes used to form the ventilation ducts are advantageously arranged horizontally, since the concrete element is concreted in horizontal layers, so that the tubes can best be incorporated in this way.

The vapor-tight sealing layer may also be formed as the carrier for the heat insulating layer and be attached merely in spot-fashion to the container wall. For attachment of the sealing layer there may be provided bolts or the like which extend into the container wall and are anchored therein and which are connected to the sealing layer. In this case the sealing layer advantageously consists of a sheet of steel which is ductile at cryogenic temperatures, e.g. invar steel.

The advantage of this design is chiefly to be seen in the fact that the attachment of the vapor sealing layer merely in spot-fashion to the container wall does not result in adhesion over the entire surface, so that there may be formed between the surface of the container wall and the vapor sealing layer cavities in which the water vapor can be relieved of stress and can condense. The condensation can percolate down through cavities, where it can accumulate and be drained off. A prerequisite for this, of course, is that the vapor sealing layer itself consists of a material whose strength and rigidity is sufficient on the one hand for it to be able to be attached in spot-fashion to the container wall and on the other hand for it to be capable of carrying the heat insulation layer firmly connected to it. The use of steel, ductile at cryogenic temperatures, e.g. invar steel, has the advantage that the difference in the variations of shape between the steel and the concrete as a result of cooling is small, so that the danger of the attachment means being ripped out is eliminated.

BRIEF DESCRIPTION OF THE DRAWING

The invention is described in greater detail below on the basis of the embodiment illustrated in the drawings. There is shown in.

DETAILED DESCRIPTION OF THE INVENTION

Figure 1:
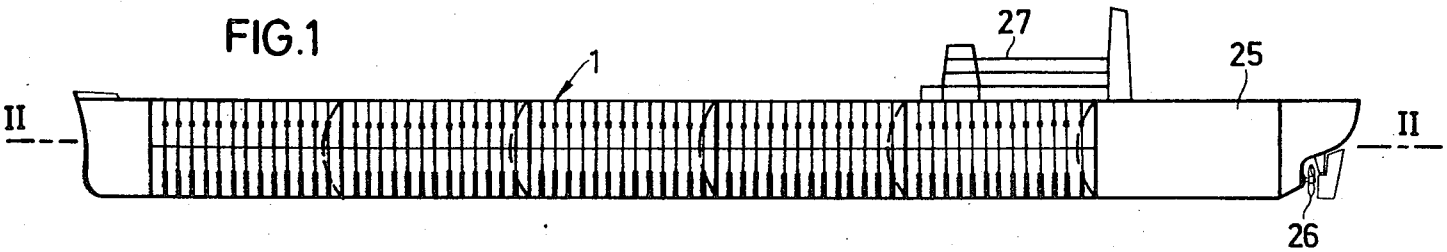
FIG. 1 a longitudinal section through a tanker.
Figure 2:
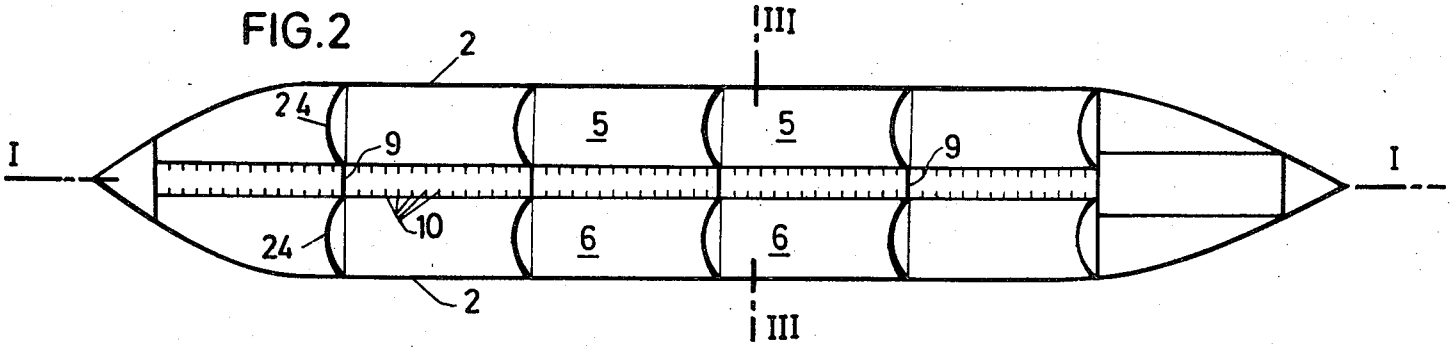
FIG. 2, a horizontal section through the tanker of FIG. 1, somewhat above the water line.

In the case of the embodiment of a tanker ship shown in FIGS. 1 to 7 of the drawings, the outer side walls 2, the bottom 3 and the deck 4 of the hull 1 consist of massive slabs of reinforced concrete. The hull 1 is substantially rectangular in cross-section, with markedly rounded corners. The rounding-off may be so pronounced that the outer wall appears almost completely curved. The cross-section (FIG. 3) comprises three compartments 5, 6 and 7 capable of being used as tank compartments. The partition wall 8 is rigidified on the side facing the central tank compartment 7 by means of transverse bulkheads 9 and ribs 10.

The hull 1 of the tanker is of streamlined shape. The tank compartments 5 and 6 are divided up by transverse bulkheads 24, which are curved in shape. In the stern there are located compartments 25 for the drive means for the ship's propeller 26 and the refrigeration appliances. The usual superstructure 27 is situated on deck.

Figure 3:
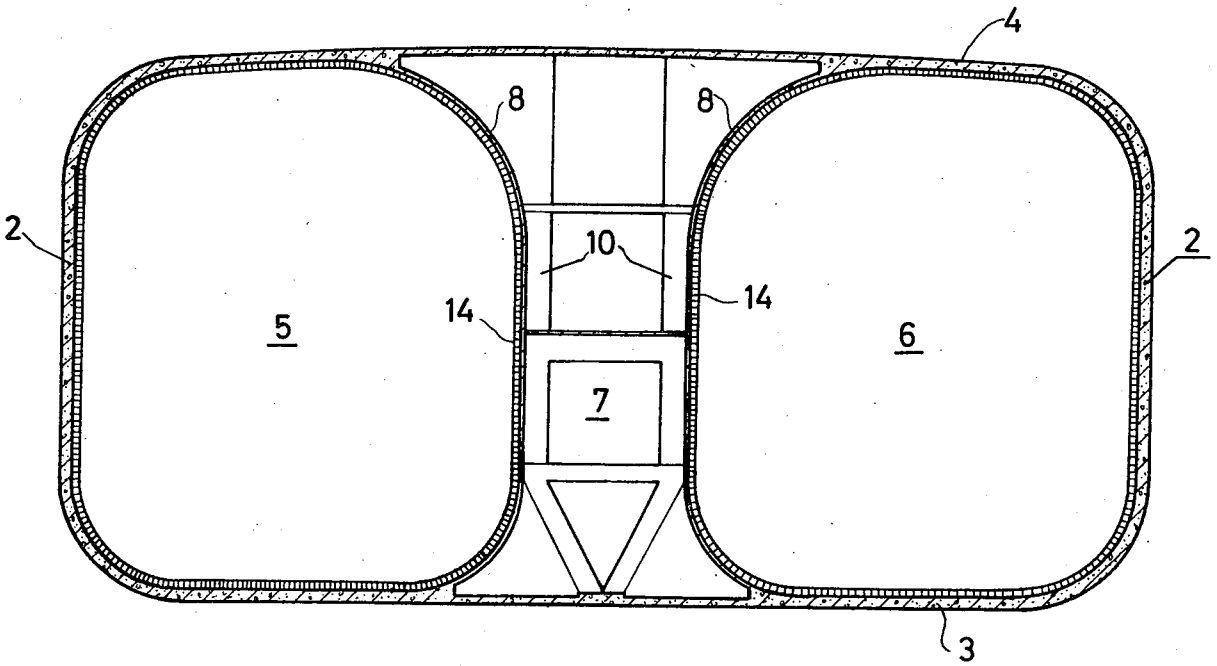
FIG. 3, a cross-section along the line III—III of FIG. 2, on an enlarged scale.
Figure 6:
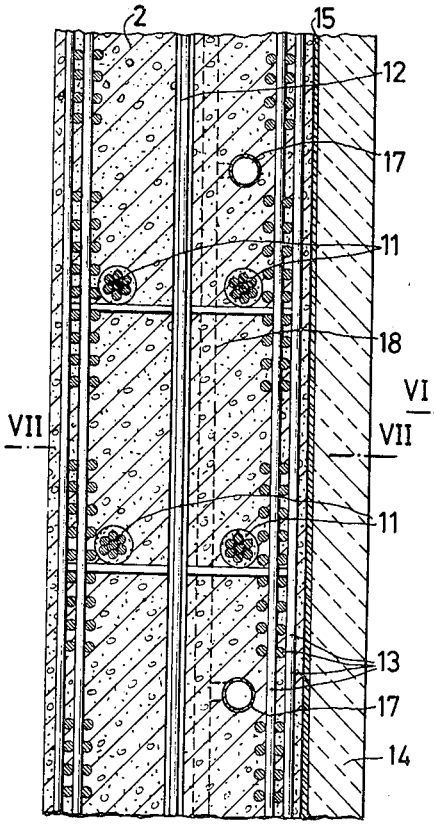
FIG. 6, a portion of the cross-section through the ship's hull of FIG. 3, on an enlarged scale.
Figure 7:
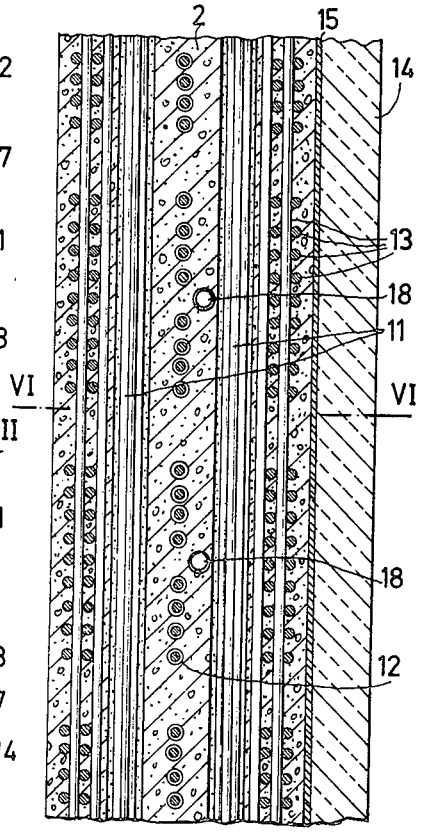
FIG. 7, a section of the line VII—VII of FIG. 6.

The outer walls 2, the bottom 3, the deck 4 and the internal walls 8 of the tanker 1 have reinforcement elements running through them, made of steel which is ductile at cryogenic temperatures FIG. 6 shows, in the form of a portion from the cross-section of FIG. 3 on an enlarged scale, a vertical section through an external wall 2; FIG. 7 shows the corresponding horizontal section.

On either side of the center plane of the wall, tension elements 11 for the prestressing reinforcement in the longitudinal direction extend in the longitudinal direction of the ship's hull 1. Between these there are provided vertical tension elements 12 for the prestressing reinforcement in the transverse direction. The longitudinal tension elements 11 are shown as bundles of several individual elements. The free, i.e. nonprestressing reinforcement 13 is provided in the form of steel rods in several layers in each case in the outer region of the external wall 2.

The container walls, in other words the external walls 2, the bottom 3, the deck 4 and the internal walls 8, are in each case provided on their inside with a heat insulating layer 14, e.g. of polyurethane foam. Between the container wall and the heat insulating layer 14 there is provided a vapor-tight sealing layer 15.

Figure 4:
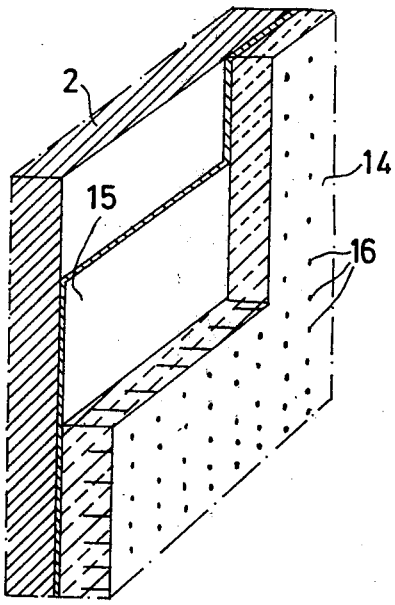
FIG. 4, a portion of the outer wall of the ship, with the insulating layers.
Figure 5:
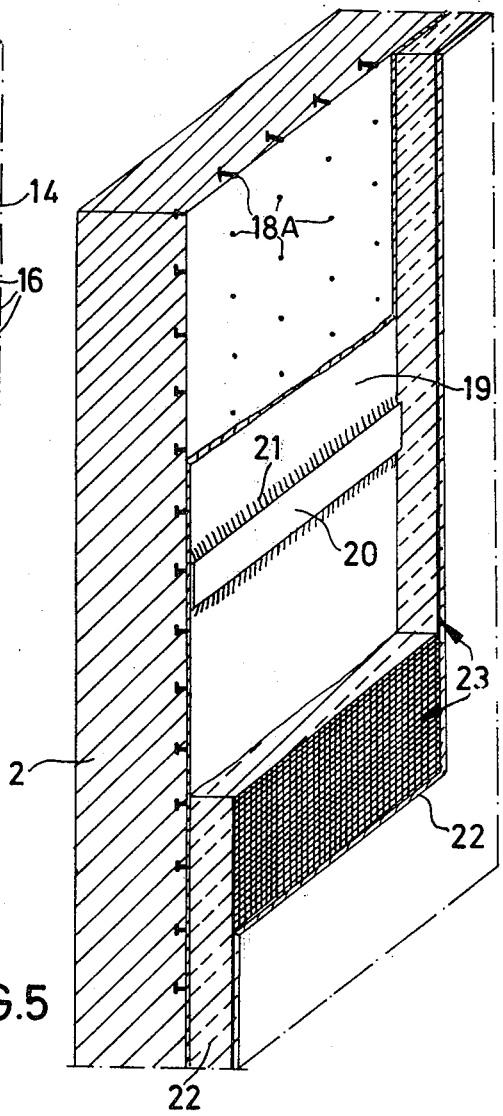
FIG. 5, likewise a portion of the outer wall, showing a different embodiment of the insulating layer.

The nature of the insulation is shown in detail in FIGS. 4 and 5, which show in oblique view portions of the container wall in which the individual layers of the insulation have been partly removed in order to show their assembly.

In the example shown in FIG. 4, there is first applied to the concrete wall 2 a vapor-tight sealing layer 15 of epoxy resin. On this sealing layer 15 there is then a heat insulating layer 14 of polyurethane foam. It is sprayed in layers on to the vapor-tight layer 15 in such a way as to adhere firmly thereto. In the example shown in FIG. 4, after the application of the heat insulating layer 14 holes 16 are made in the surface thereof, though these extend only part of the way into the layer 14. The insulating layer 14 is wetted in the region of these holes 16 upon contact with the liquefied gas, so that in a boundary zone in the interior of the insulating layer there can build up a gas pressure which maintains the equilibrium of the pressure of the liquid.

In order to dissipate or completely eliminate the pressure on the vapor-tight sealing layer 15 of any moisture diffusing through the concrete wall 2, there may be provided in the concrete wall 2 ventilation ducts in which the water vapor can condense and then be extracted as a result of natural or forced ventilation. In FIGS. 6 and 7 there are shown horizontally extending tubes 17 which are connected to one another by vertical ducts 18. The tubes 17, which consist of a material having a permeability similar to that of concrete, e.g. asbestos cement, are arranged horizontally because the concrete element in horizontal layers and the tubes can best be incorporated in this way.

A further possibility for keeping the vapor pressure away from the heat insulating layer is shown in FIG. 5. In this case, bolts 18A are embedded in the container wall 2 at regular distances from one another, to which bolts a vapor-tight seal layer 19 is attached. The layer 19 in this case consists of a steel sheet, which is attached to the bolts 18A by welding. Advantageously, the bolts 18A are attached to the steel sheet beforehand and the latter together with the bolts is incorporated into the shuttering, so that from the outset a satisfactory embedding of the bolts 18A in the concrete wall 2 can be achieved.

There must be no connection between the concrete of the container wall 2 and the vapor-tight sealing layer 19. It may be prevented by appropriate measures, e.g.. by coats of paint. Joints in the layer 19 can be bridged by welding butt straps 20 on by means of weld seams 21.

To the vapor-tight sealing layer 19 there is then applied the heat insulating layer 22, in which there may if desired also be embedded a reinforcement 23, e.g. of glass fiber fabric.

Figure 8:
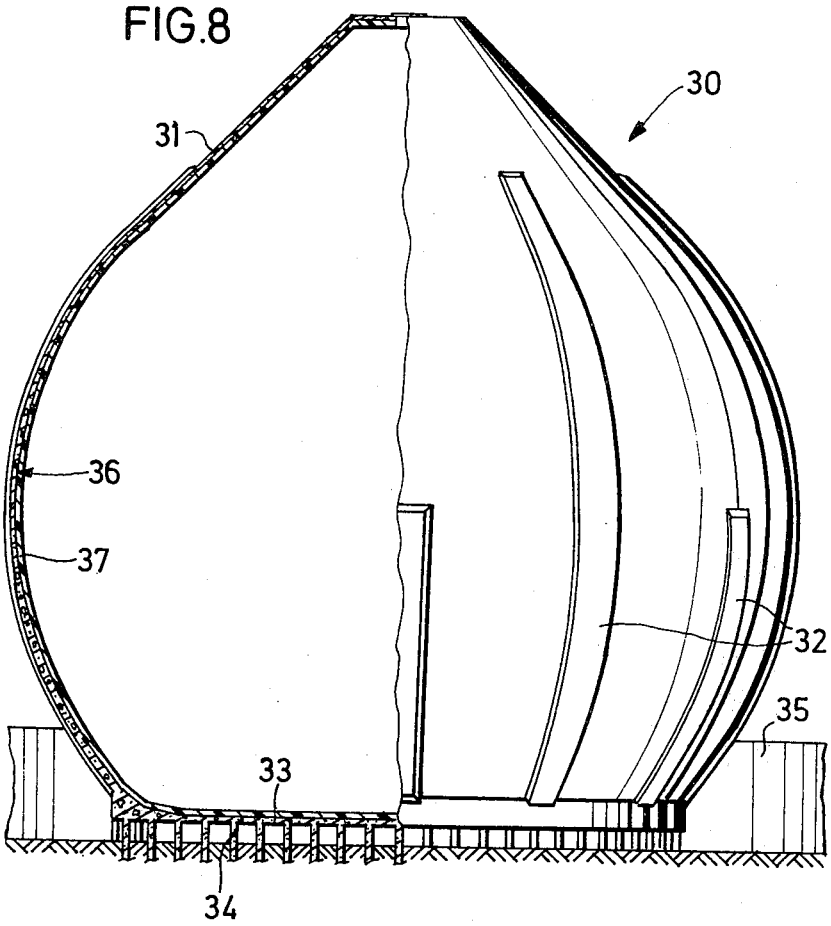
FIG. 8, a land tank, partly in vertical section and partly in elevation.
Figure 9:
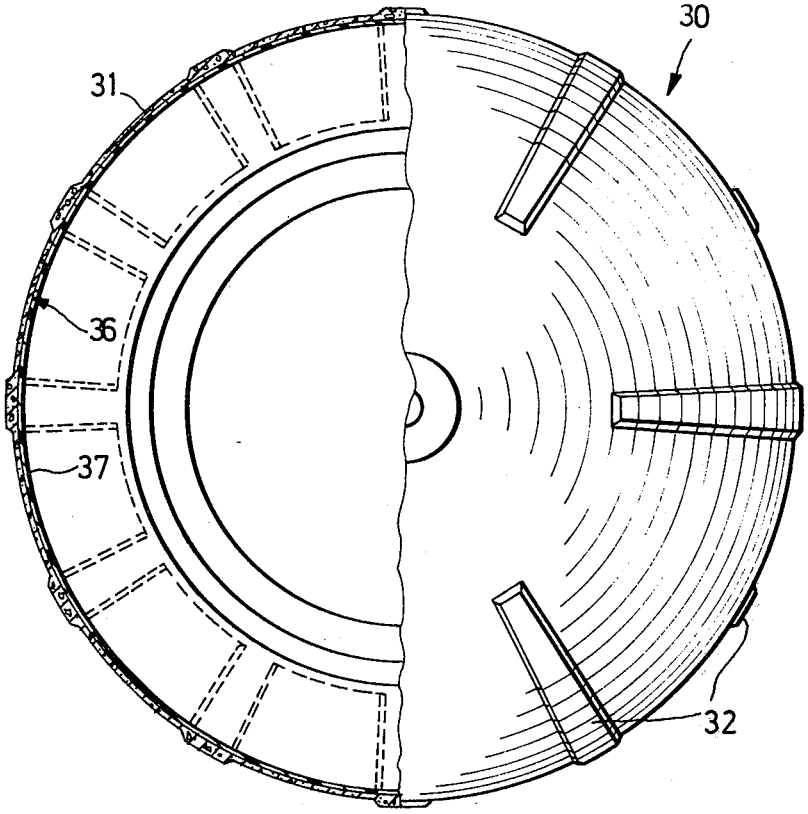
FIG. 9, the land tank of FIG. 8, partly in horizontal section and partly in plan view.

In FIGS. 8 and 9 there is illustrated a land tank constructed in accordance with the invention. The walls 31 of the container 30 form substantially a pear shape. Thickening ribs 32 are provided on the outside. The container 30 rests with its floor plate 33 on piles 34. For safety reasons, it is surrounded by a catch container 35. On the inside of the container wall 31 there are provided a vapor sealing layer 36 and a heat insulating layer 37 which may be constructed as described in connection with FIGS. 4 and 5.

What is claimed is:

1. Container for liquified gas comprising a load-bearing container structure, said structure comprising an enclosing solid and rigid load-bearing concrete wall having a reinforcement of steel which is ductile at cryogenic temperatures, a vapor-tight sealing layer formed on the inside surface of said concrete wall, and a heat insulating barrier attached to said vapor-tight sealing layer which is continuously applied for forming a joint free continuous insulating body.

2. Container according to claim 1, wherein said vapor-tight sealing layer comprises a synthetic resin such as epoxy resin.

3. Container according to claim 1, wherein said heat insulating layer comprises an inside surface contacting the gas in said container and an outside surface, said inside surface of said heat insulating layer having a series of holes formed therein and extending from said inside surface a distance less than the thickness of said heat insulating layer from the inner surface to the outside surface thereof.

4. Container according to claim 3, wherein said series of holes having each a diameter on the order of approximately 1 mm are provided in said inside surface with one hole provided for each 100 to 5000mm$^2$ of said surface.

5. Container according to claim 1, wherein said concrete wall of said container comprises a system of interconnecting cavities exposed to one of a natural or artificial draught.

6. Container according to claim 5, wherein said cavities comprise ventilation ducts including tubes concreted into said concrete wall, said tubes being made of a material having a permeability to moisture which corresponds to concrete.

7. Container according to claim 6, wherein said tubes are made of asbestos cement.

8. Container according to claim 1, wherein said vapor-tight sealing layer is formed as a carrier for said heat insulating layer, said vapor-tight sealing layer being attached to said wall in spot-fashion.

9. Container according to claim 8, further comprising a plurality of bolts for attaching said vapor-tight sealing layer to said wall, said bolts extending into said wall and anchored therein, and connected to said sealing layer to afford such attachment.

10. Container according to claim 8, wherein said vapor-tight sealing layer comprises a sheet of steel which is ductile at cryogenic temperatures, such as invar steel.

11. Container according to claim 1, wherein said container structure comprises the outer skin of a ship's hull.

12. Container according to claim 1, wherein said reinforcement of steel in said concrete wall is prestressed.

* * * * *